US007235003B2

(12) United States Patent
Thysell

(10) Patent No.: US 7,235,003 B2
(45) Date of Patent: Jun. 26, 2007

(54) METHOD AND APPARATUS FOR GRINDING OF CONCRETE FLOORS

(75) Inventor: Håkan Thysell, Söderköping (SE)

(73) Assignee: HTC Sweden AB, Soderkoping (SE)

( * ) Notice: Subject to any disclaimer, the term of this patent is extended or adjusted under 35 U.S.C. 154(b) by 64 days.

(21) Appl. No.: 11/086,559

(22) Filed: Mar. 23, 2005

(65) Prior Publication Data

US 2005/0250422 A1 Nov. 10, 2005

Related U.S. Application Data

(60) Provisional application No. 60/556,381, filed on Mar. 26, 2004.

(51) Int. Cl.
*B24B 1/00* (2006.01)

(52) U.S. Cl. ..... 451/54; 451/28; 451/350; 451/449; 451/450; 451/456

(58) Field of Classification Search ..... 451/344, 451/350, 351, 352, 353, 449, 450, 456, 28, 451/54; 125/13.01
See application file for complete search history.

(56) References Cited

U.S. PATENT DOCUMENTS 2,711,620 A * 6/1955 Shelby ..... 451/456
2,956,379 A 10/1960 Statler
3,037,755 A 6/1962 Hatcher
3,581,364 A 6/1971 Wyse
3,848,929 A * 11/1974 Miller ..... 299/39.4
4,676,557 A * 6/1987 Shope et al. ..... 299/39.3
5,085,008 A * 2/1992 Jennings et al. ..... 451/184
5,605,493 A 2/1997 Donatelli et al.
6,238,277 B1 5/2001 Duncan et al.
6,450,869 B1 * 9/2002 Sherez ..... 451/449
6,786,556 B2 * 9/2004 Due ..... 299/36.1
7,073,495 B1 * 7/2006 Markley ..... 125/13.01

FOREIGN PATENT DOCUMENTS

WO WO 03/076131 A1 9/2003

* cited by examiner

*Primary Examiner*—Eileen P. Morgan
(74) *Attorney, Agent, or Firm*—Harness, Dickey & Pierce, P.L.C.

(57) ABSTRACT

A method for dry finishing of a floor surface consisting of concrete, stone, marble, terrazzo, densite or other hard materials is disclosed. The method comprises finishing of the floor surface using a cutting, grinding and/or polishing tool. In the method, a vapor or aerosol is applied to the floor surface and/or the tool in connection with said dry finishing. An apparatus and a set of parts for carrying out the method are also disclosed.

8 Claims, 1 Drawing Sheet

METHOD AND APPARATUS FOR GRINDING OF CONCRETE FLOORS

CROSS REFERENCE TO RELATED APPLICATIONS

This U.S. non-provisional application claims priority under 35 USC § 119 to U.S. Provisional Application No. 60/556,381, filed Mar. 26, 2004.

FIELD OF THE INVENTION

The present invention relates to a method and an apparatus for dry finishing of a floor surface consisting of concrete, stone, marble, terrazzo, densite or other hard floor surfaces, said method comprising finishing of the floor surface using a milling, grinding and/or polishing tool.

BACKGROUND ART

It is known that hard floor surfaces such as stone, concrete, terrazzo, marble, granite etc. can be surfaced by dry grinding and/or polishing. Examples of machines that are suitable for such dry grinding are disclosed in WO03/076131 and U.S. Pat. No. 6,238,277B1. By dry grinding is meant grinding without supplying water or some other liquid to the floor surface and/or the tool finishing the floor surface. In rough grinding, it is not unusual that 40–120 kg of dust (dry weight) an hour are generated.

A drawback in dry grinding is that the working temperature, especially in connection with very hard floor surfaces, become so high that only a limited variety of tools can be used. For instance, when temperatures above 300° C. are measured on the surface of a tool, it can be assumed that the diamond tip of the tool is still hotter and thus risks being destroyed.

U.S. Pat. No. 5,605,493 discloses apparatus and methods for wet grinding of stone floors, such as marble and granite, where a lubricant is applied to the floor surface in grinding, to be sucked up by a wet vacuum cleaner after grinding. As stated in U.S. Pat. No. 5,605,493, efficient wet grinding requires an apparatus that can apply a lubricant, grind, and collect the lubricant.

It is known that wet grinding consumes 100–300 l of water/h, i.e. 2–6 l of water/$m^2$.

A drawback in wet grinding is that a large and heavy amount of slurry, consisting of lubricant and grinding dust, must be handled and deposited. A further drawback in wet grinding is that extensive cleaning is required after each completed grinding operation.

There is thus a need for a method and an apparatus that eliminate the drawbacks of dry and wet grinding.

SUMMARY OF THE INVENTION

An object of the present invention is to provide a method and an apparatus for dry finishing of floor surfaces, which wholly or partly eliminate the drawbacks of prior art.

The object is achieved by a method, an apparatus and a set of parts according to the respective independent claims. Embodiments will be evident from the dependent claims and from the following description and the drawings.

According to a first aspect, a method is provided for dry finishing of a floor surface consisting of concrete, stone, marble, terrazzo, densite or other hard materials, said method comprising finishing of the floor surface using a milling, grinding and/or polishing tool. In the method, a vapor or aerosol is applied only to the floor surface or to the floor surface and the tool in connection with said dry finishing, and said vapor or aerosol is applied in an amount which is sufficiently large to cool the tool but sufficiently small for dust generated in finishing to remain so dry that it can be sucked up by means of a dry vacuum cleaner.

By "dry finishing" is meant finishing which occurs in a substantially dry manner, i.e. without supply of water or other liquid for the purpose of lubricating and/or cooling the tool and the floor surface, or for the purpose of binding dust generated in finishing.

By "finishing" is in the first place meant grinding and/or polishing, but the term may also comprise milling.

It will be appreciated that the expression "vapor or aerosol" comprises vapor or aerosol which mainly consists of water. The term "aerosol" comprises especially mist which consists of droplets and/or crystals of water or some other cooling substance.

By applying vapor or aerosol to the floor surface and/or the tool, sufficient cooling of the tool is provided, while at the same time grinding can be performed under dry conditions, i.e. the grinding dust is sufficiently dry to be handled by means of a dust collector/dust separator as is used in dry finishing. This eliminates the problem with handling and depositing of slurry.

The reduction of the working temperature reduces the wear on the tool and makes it possible to use several types of diamond tools, especially of a harder type, and a higher working pace as well. Alternatively, the need for special temperature-resistant tools for dry grinding is eliminated, and the number of variants manufactured and kept in stock can be reduced. Moreover, new types of tools involving thermoplastic and/or ceramics can be used, which up to now could be used in wet grinding only since they have otherwise become overheated and destroyed.

It is also made possible to use existing apparatus adapted for dry finishing with minor modifications only.

According to a second aspect, an apparatus for dry finishing of a floor surface consisting of concrete, stone, marble, terrazzo, densite or other hard materials is provided, said apparatus comprising a milling, grinding and/or polishing tool arranged to finish the floor surface. The apparatus has means for applying a vapor or aerosol only to the floor surface or to the floor surface and the tool in connection with said dry finishing, said means being arranged so that said vapor or aerosol is applied in an amount which is sufficiently large to cool the tool but sufficiently small for dust generated in finishing to remain so dry that it can be sucked up by means of a dry vacuum cleaner.

According to a third aspect, a set of parts for forming the above-described apparatus is provided. The set of parts comprises a machine for milling, grinding and/or polishing dry finishing of the floor surface, and a device for applying a vapor or aerosol only to the floor surface or to the floor surface and the tool in connection with said dry finishing, which device for applying a vapor or aerosol is adapted to be arranged on the machine, said device being arranged so that said vapor or aerosol is applied in an amount which is sufficiently large to cool the tool but sufficiently small for dust generated in finishing to remain so dry that it can be sucked up by means of a dry vacuum cleaner.

The invention will now be described in more detail with reference to the accompanying drawings.

DESCRIPTION OF PREFERRED EMBODIMENTS

Figure 1:
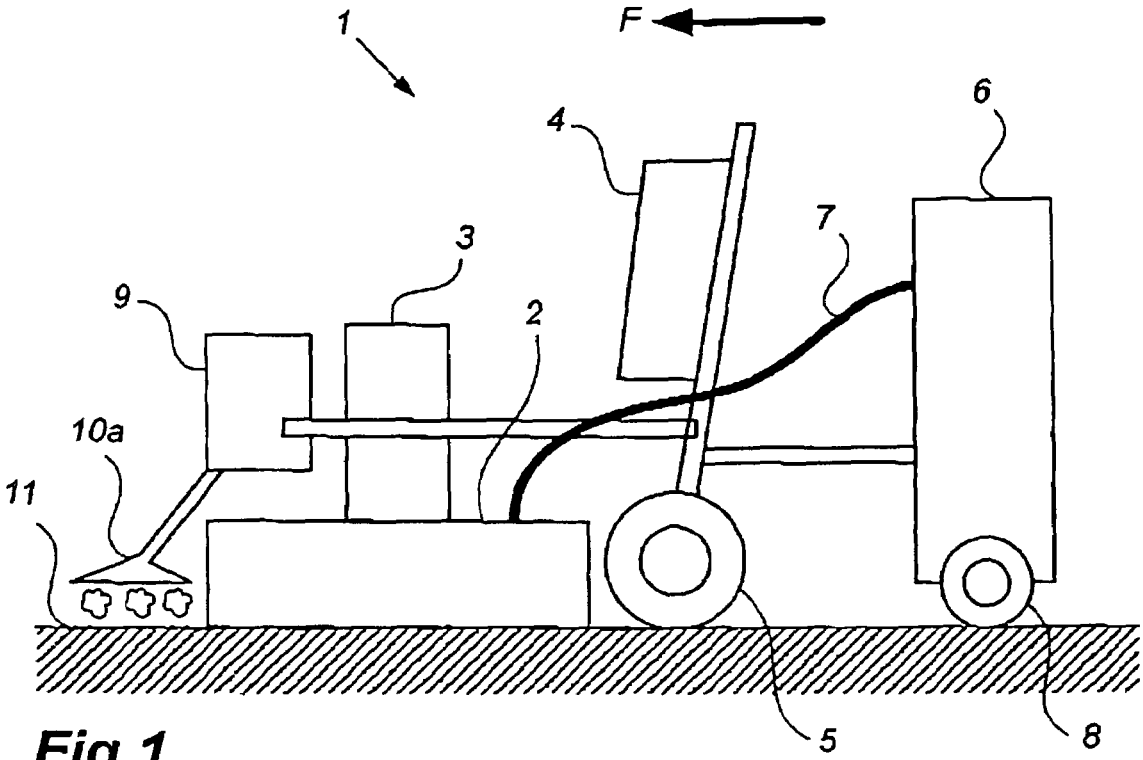
FIG. 1 is a schematic side view of a finishing machine with a connected dust collector according to a first embodiment.

FIG. 1 is a schematic side view of a finishing machine 1 of a type similar to the one disclosed in WO03/076131 and, connected thereto, a dust collector 6 according to a first embodiment.

The finishing machine has a casing 2 which encloses a rotatably mounted and driven disc (not shown) on which one or more cutting, grinding and/or polishing tools (not shown) are arranged. When the finishing machine 1 is in operation, the tool is in finishing engagement with the floor surface 11. The tool can comprise, for instance, a milling tool, a grinding tool and/or a polishing tool. The disc is driven by a motor 3, and the machine is controlled by a control module 4, which contains functionality for feeding and/or controlling the power supply of the motor. The finishing machine is movable by means of wheels 5. In the embodiment shown in FIG. 1, the finishing machine is adapted to be moved in a traveling direction F, but it will be appreciated that the finishing machine can also be moved in a direction opposite to F.

In one embodiment, the finishing machine 1 is designed to be propelled by the operator pushing it in front of himself or alternatively pulling it along.

In another embodiment, the finishing machine 1 is designed to be propelled by means of a propulsion mechanism arranged thereon, such as a motor, which optionally can be remote-controlled, as shown in WO03/076131.

FIG. 1 also shows that a dust collector 6 is connected by a tube 7 to the casing 2 of the finishing machine, so that dust generated in the finishing of the floor surface 11 is collected in a container (not shown) arranged in the dust collector. As shown in FIG. 1, the dust collector can be arranged as a carriage, which is pulled by the finishing machine.

The finishing machine shown in FIG. 1 also has a generator 9 for aerosol (mist) or vapor, which is arranged to apply, by a nozzle 10*a*, aerosol and/or vapor to the floor surface 11 just in front of the finishing machine, in the traveling direction F thereof.

In one embodiment, the aerosol or vapor is applied to the floor surface 11 within an area in front of the finishing machine, said area having substantially the same width as the casing of the finishing machine.

In another embodiment, the aerosol or vapor is applied to the floor surface within an area in front of the finishing machine, which area is slightly narrower than the width of the casing of the finishing machine.

In yet another embodiment, the aerosol or vapor is applied to the floor surface within an area in front of the finishing machine, which area is substantially narrower than the width of the casing of the finishing machine.

In one embodiment, aerosol or vapor is mainly formed of water. In the embodiments where an aerosol is used, this may consist of an optional, possibly diluted, grinding liquid and/or cooling liquid, such as water glass, i.e. silicates of sodium or potassium which under high pressure and at high temperature have been dissolved in water. As a further example, small amounts of soft soap can be added to the water.

In another embodiment, the vapor or aerosol can be formed of carbon acid, such as dry ice or other known agents that in finishing have a lubricating and/or cooling function.

In one embodiment, vapor or aerosol is applied in an amount which is sufficiently large to cool the tool but sufficiently small for dust generated in finishing to remain so dry that it can be sucked up by means of a dry vacuum cleaner. Specifically, the amount of vapor or aerosol can be determined based on the cooling effect that is desirable. This cooling effect depends on, for instance, the finishing speed, the type of finished floor surface, the type of tool and the ambient temperature.

In an embodiment tested by the Applicant, Applicant's existing grinding machine was fitted with a mist generator as disclosed in U.S. Pat. No. 6,450,869B1.

In additional embodiments, use is made of 0.1–10 l of water/h on a surface of 50–100 $m^2$/h. This means 0.001 l of water/$m^2$–0.2 l of water/$m^2$.

In one embodiment, use is made of 2–3 l of water/h on a surface of 50–100 $m^2$/h, which corresponds to 0.02 l of water/$m^2$–0.06 l of water/$m^2$. This quantity of water makes it possible to use the dust collectors/dust separators that are used in dry grinding according to prior art, without problems with slurry.

Figure 2:
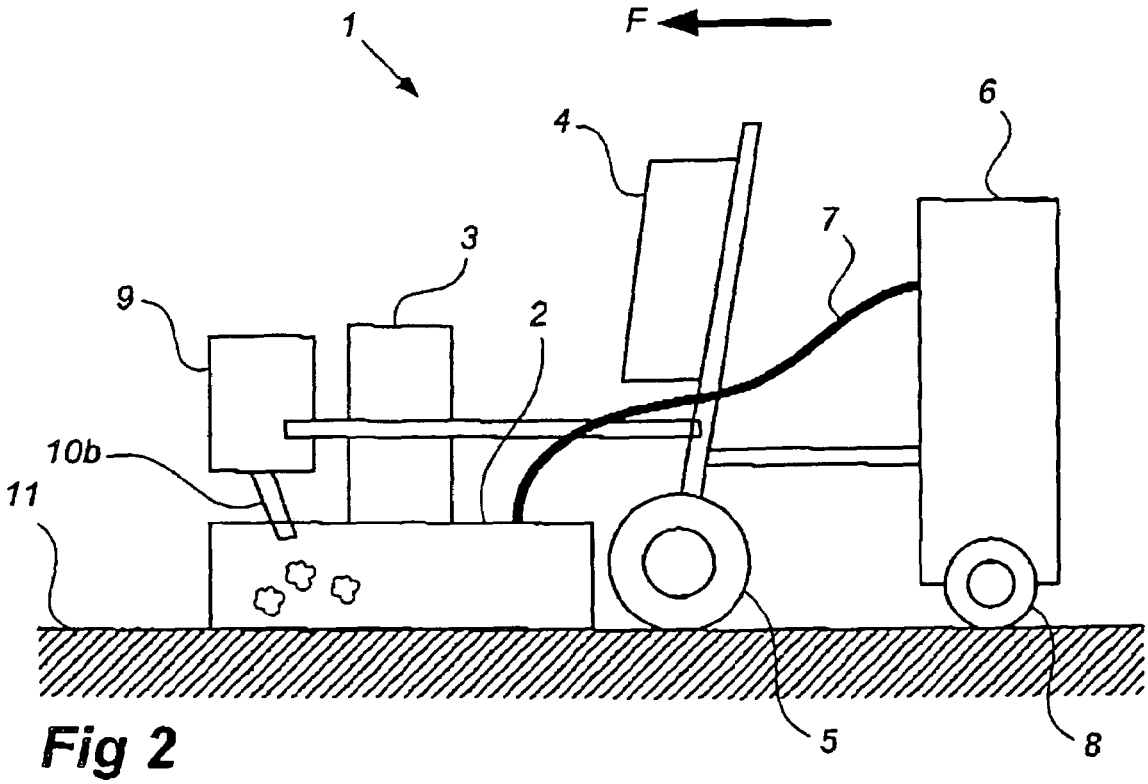
FIG. 2 is a schematic side view of a finishing machine with a connected dust collector according to a second embodiment.

FIG. 2 is a schematic side view of a finishing machine with a connected dust collector according to a second embodiment.

The finishing machine in FIG. 2 is largely identical to the one shown in FIG. 1 and has thus been described above. The difference from the finishing machine shown in FIG. 1 is that in FIG. 2 the generator 9 for the aerosol or vapor is arranged to supply through a nozzle 10*b* the aerosol or vapor inside the casing 2.

In one embodiment, the nozzle 10*b* is arranged so that the aerosol or vapor is applied to the floor surface inside the casing 2.

In another embodiment, the nozzle 10*b* is arranged so that the aerosol or vapor is applied to the tool.

In yet another embodiment, the nozzle 10*b* is arranged so that the aerosol or vapor is applied substantially freely within the casing 2.

The above embodiments of the nozzle 10*b* can be combined with each other and also with the embodiments shown with reference to FIG. 1.

What I claim and desire to secure by Letters Patent is:

1. A method for dry finishing of a floor surface consisting of concrete, stone, marble, terrazzo, densite or other hard materials, said method comprising:

finishing of the floor surface using a milling, grinding and/or polishing tool, applying an aerosol only to the floor surface or to the floor surface and the tool in connection with said dry finishing, said aerosol being applied in an amount exceeding 1 ml liquid/$m^2$ to cool the tool and less than 200 ml liquid/$m^2$ so that dust generated remains so dry that it can be sucked up by a dry vacuum cleaner.

2. A method as claimed in claim 1, in which finishing is performed while moving the tool, and in which said aerosol is applied to the floor surface immediately in front of the tool.

3. A method as claimed in claim 1, in which said aerosol is applied within a casing enclosing the tool.

4. A method as claimed in claim 1, in which said aerosol is applied to the floor surface in an amount exceeding 2 ml liquid/$m^2$ and less than 100 ml liquid/$m^2$.

5. A method as claimed in claim 1, in which said aerosol is applied to the floor surface in an amount exceeding 20 ml liquid/$m^2$ and less than 60 ml liquid/$m^2$.

6. A method as claimed in claim 1, in which said aerosol comprises water.

7. An apparatus for dry finishing of a floor surface consisting of concrete, stone, marble, terrazzo, densite or other hard materials, said apparatus comprising:

a milling, grinding and/or polishing tool arranged to finish the floor surface; and means for applying an aerosol only to the floor surface or to the floor surface and the tool in connection with said dry finishing;

said means being arranged so that said aerosol is applied in an amount exceeding 1 ml liquid/$m^2$ to cool the tool and less than 200 ml liquid/$m^2$ so that dust generated remains so dry that it can be sucked up by a dry vacuum cleaner.

8. A kit for forming an apparatus for dry finishing a floor surface, the kit comprising:

a machine for milling, grinding and/or polishing the floor surface; and a device for applying an aerosol only to the floor surface or to the floor surface and the tool in connection with said dry finishing, said device for applying the aerosol being adapted to be arranged on the machine, and apply the aerosol in an amount exceeding 1 ml liquid/$m^2$ to cool the tool and less than 200 ml liquid/$m^2$ so that dust generated remains so dry that it can be sucked up by a dry vacuum cleaner.

* * * * *